US010933950B1

(12) United States Patent
Chaney

(10) Patent No.: US 10,933,950 B1
(45) Date of Patent: Mar. 2, 2021

(54) MODULAR RECREATIONAL WATERCRAFT

(71) Applicant: John Chaney, Portland, OR (US)

(72) Inventor: John Chaney, Portland, OR (US)

( * ) Notice: Subject to any disclaimer, the term of this patent is extended or adjusted under 35 U.S.C. 154(b) by 0 days.

(21) Appl. No.: 16/719,631

(22) Filed: Dec. 18, 2019

(51) Int. Cl.
*B63B 7/08* (2020.01)
*B63B 34/20* (2020.01)
*B63B 7/00* (2020.01)

(52) U.S. Cl.
CPC ..... *B63B 7/082* (2013.01); *B63B 7/087* (2013.01); *B63B 34/20* (2020.02); *B63B 2007/003* (2013.01); *B63B 2241/24* (2013.01)

(58) Field of Classification Search
CPC ..... B63B 2007/003; B63B 2007/065; B63B 7/00; B63B 7/02; B63B 7/04; B63B 7/06; B63B 7/08; B63B 7/082; B63B 7/085; B63B 32/51; B63B 32/55; B63B 34/22; B63B 34/23; B63B 2241/24
See application file for complete search history.

(56) References Cited

U.S. PATENT DOCUMENTS 4,766,830 A * 8/1988 Kunz ..... B63B 1/121 114/127
4,915,047 A * 4/1990 Lord ..... B63B 1/121 114/123
5,413,066 A * 5/1995 Spencer, Jr. ..... B63B 7/082 114/354
5,878,688 A * 3/1999 Merrett ..... B63B 7/082 114/345
6,343,560 B1 * 2/2002 Myers ..... B63B 1/121 114/354
9,045,200 B1 * 6/2015 Chaney ..... B63B 35/14

* cited by examiner

*Primary Examiner* — Andrew Polay
(74) *Attorney, Agent, or Firm* — Mark S Hubert

(57) ABSTRACT

A recreational watercraft system of interconnectable, inflatable tubes that can incorporate a configurable frame that may be removably affixed at different vertical heights to attachment brackets that are axially strapped around the inflatable tubes. A plethora of accessories are available to accommodate, oars, paddles, masts, motors and the like, depending on what watercraft shape has been assembled. It can be assembled into a canoe, raft, motorboat, sailboat, fishing float etc.

9 Claims, 22 Drawing Sheets

FIG. 8
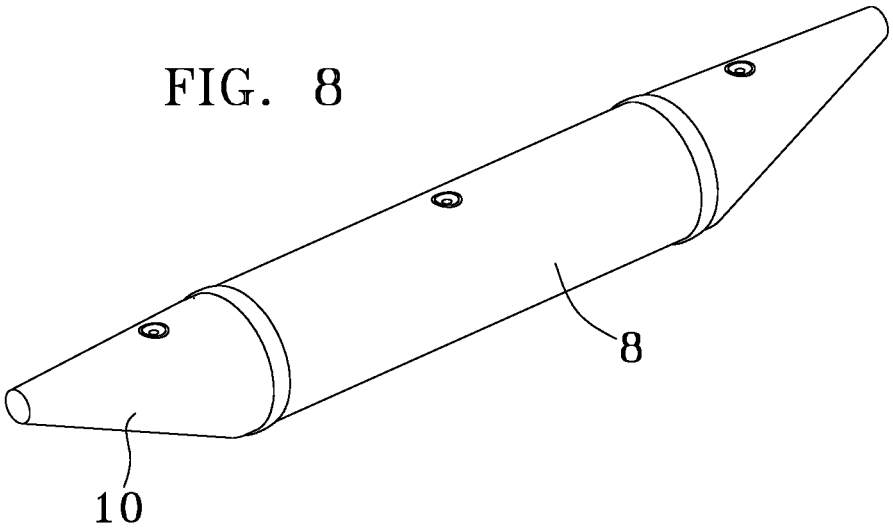
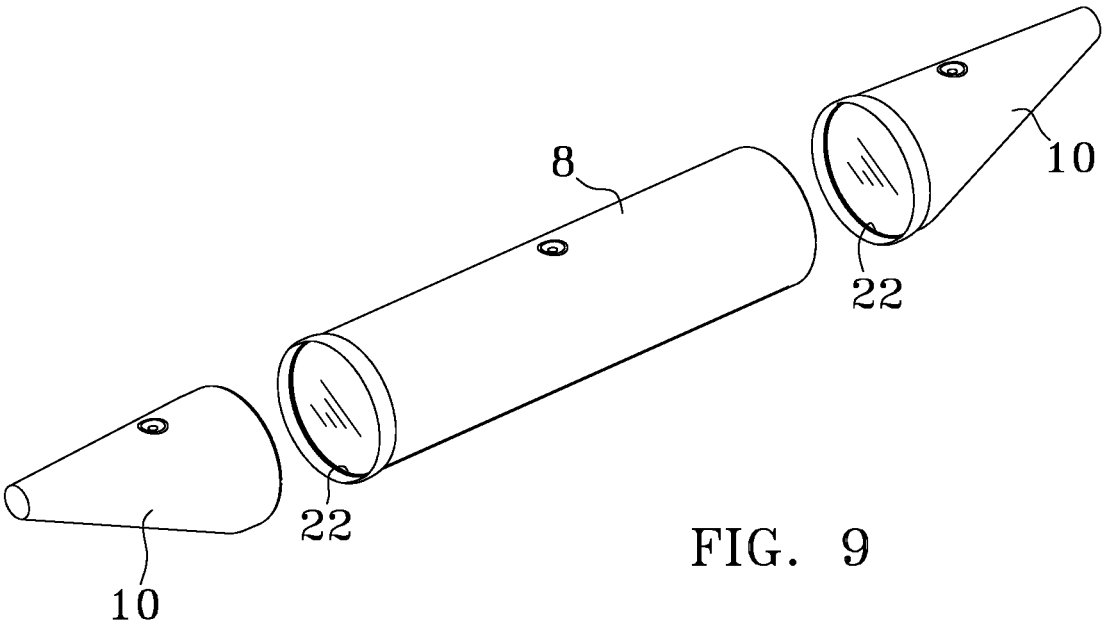
FIG. 9

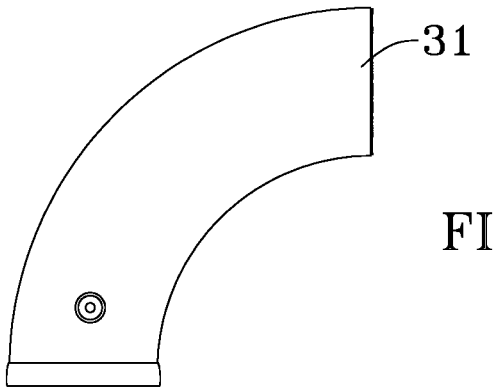
FIG. 11
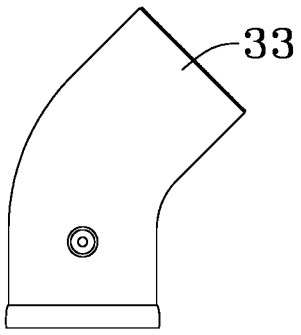
FIG. 12
FIG. 13
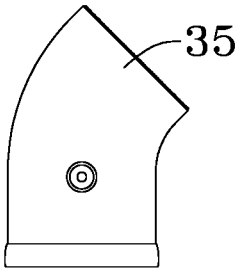

MODULAR RECREATIONAL WATERCRAFT

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to recreational watercraft, and more particularly to a modularly configurable, inflatable, recreational watercraft.

BACKGROUND

The ownership of personal watercraft in the USA is on the rise. Much of this is because of newer watercraft materials that require less maintenance, are more durable and less expensive. The mechanical and electronic related aspects such as motors, fish finders, navigation, depth finders, radios and the like, have also been simplified and made more dependable.

With the majority of baby boomers going into retirement, there is more time for this growing segment to recreate. People enjoy a plethora of waterway activities including kayaking, rafting, canoeing, fishing, rowing, and paddle boarding to name a few. Each of these activities require their own specific watercraft. For example, just for fishing there are drift boats, rafts, mini pontoon boats and pontoon platform configurations. All of these watercrafts are for specific purposes. Thus, a person that embraces many different waterway activities may need multiple watercrafts. This creates problems.

Having multiple watercraft means having the physical space for the storage of these devices. It also means having the ability to move these watercrafts from storage to the waterway. As a final complication, the use of more than one watercraft in the same day may be desirable. Generally, this requires a large garage, a dedicated tow vehicle, multiple trailers and preferably a second person to aid in the loading/unloading and trailering of the watercraft.

A watercraft that can be stored with a minimal of space, transported in any vehicle, moved about by a single person, and configured for different purposes would fulfill a long-felt need in the recreational boating industry. Such a solution is provided by the embodiments set forth below.

BRIEF SUMMARY

In accordance with various embodiments, an expandable recreational watercraft is provided.

In one aspect, an inflatable set of tubular modules that may be interconnected by a zipper, a set of hook and loop fastener strips or a mechanical fastener so as to lie in a common horizontal plane is provided. The various modules may be assembled in numerous configurations to make different purposed watercraft.

In another aspect, an interchangeable array of connectable inflatable tubes to which an adjustable sized and configurable rigid frame may be affixed in variable vertical positions is provided.

In yet another aspect, a configurable watercraft made of inflatable tubes residing along a common horizontal plane where the watercraft has frame attachment brackets adjustably attachable to accommodate the affixation of a configurable frame is provided.

In a final aspect, a configurable watercraft made of a series of connected inflatable tubes having a collapsible, foldable, modular frame assembly is provided.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIGS. 8 and 9 are side perspective views of an assembled and disassembled zipper tube assembly;

FIGS. 11-13 are top views of various zipper corner tubes;

DETAILED DESCRIPTION

Figure 1:
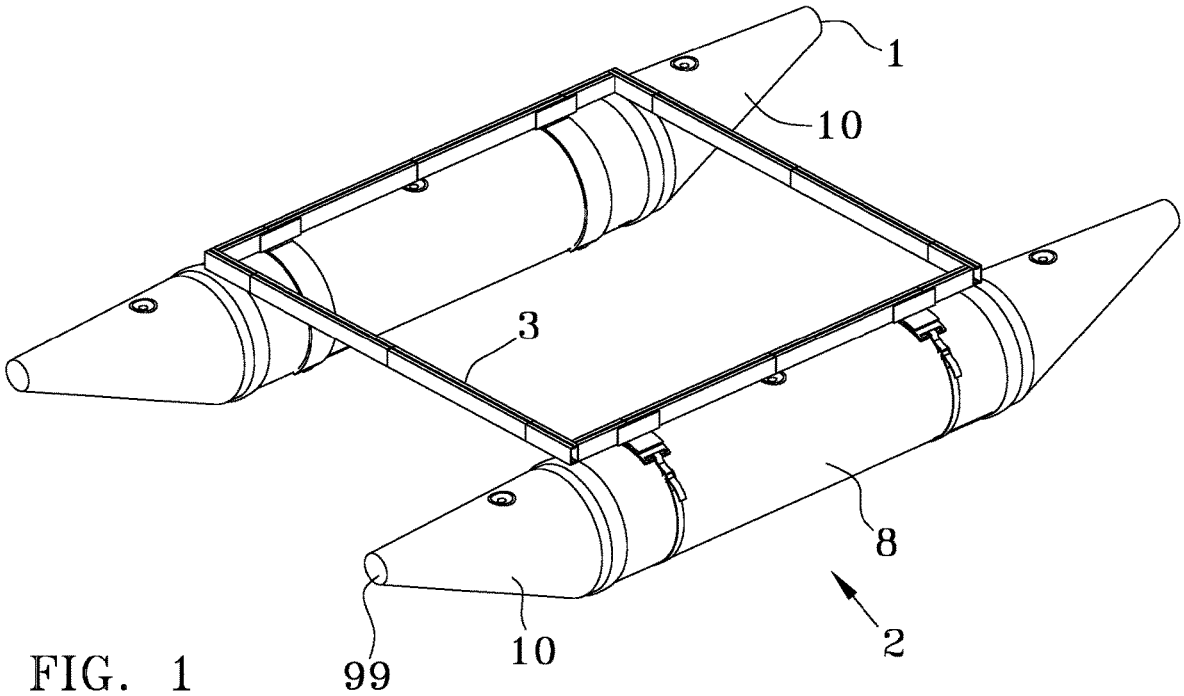
FIGS. 1-7 are perspective views of different combinations of tubes to form different watercraft.
Figure 2:
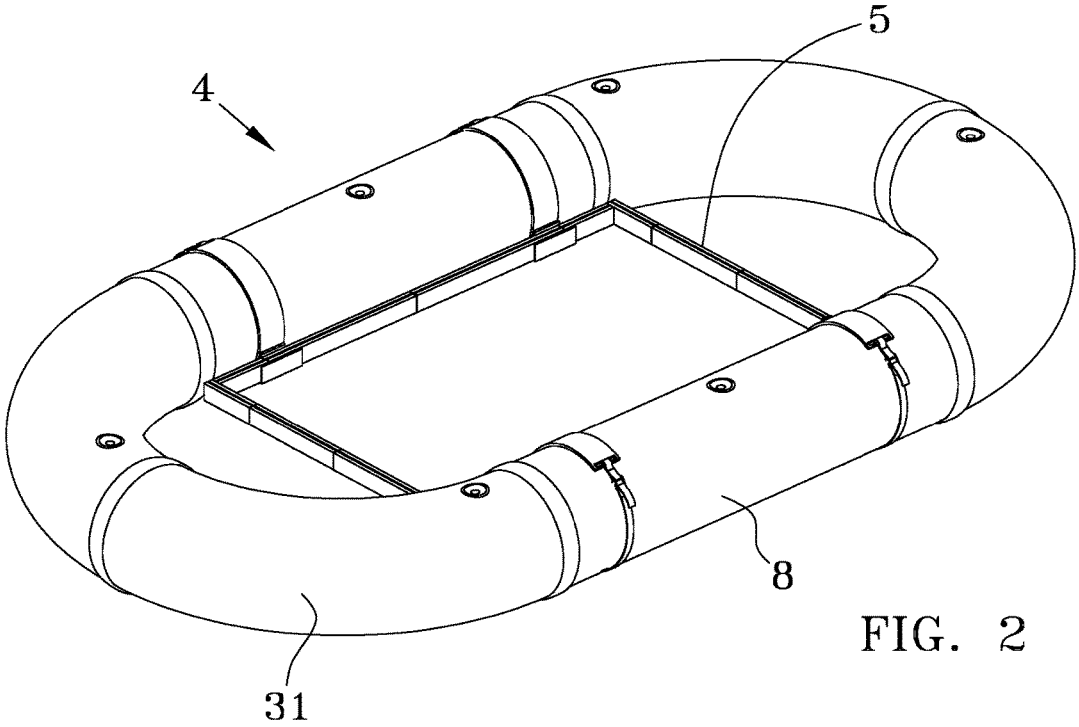
Figure 3:
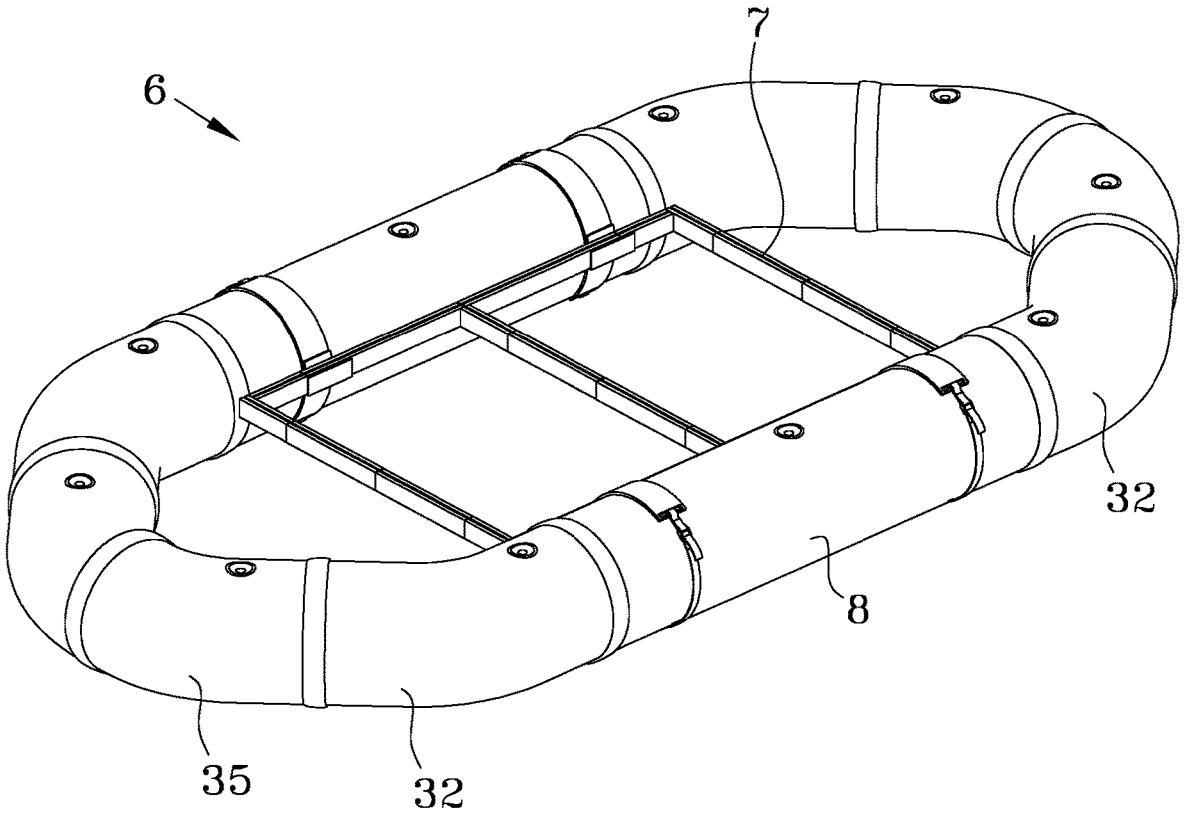
Figure 4:
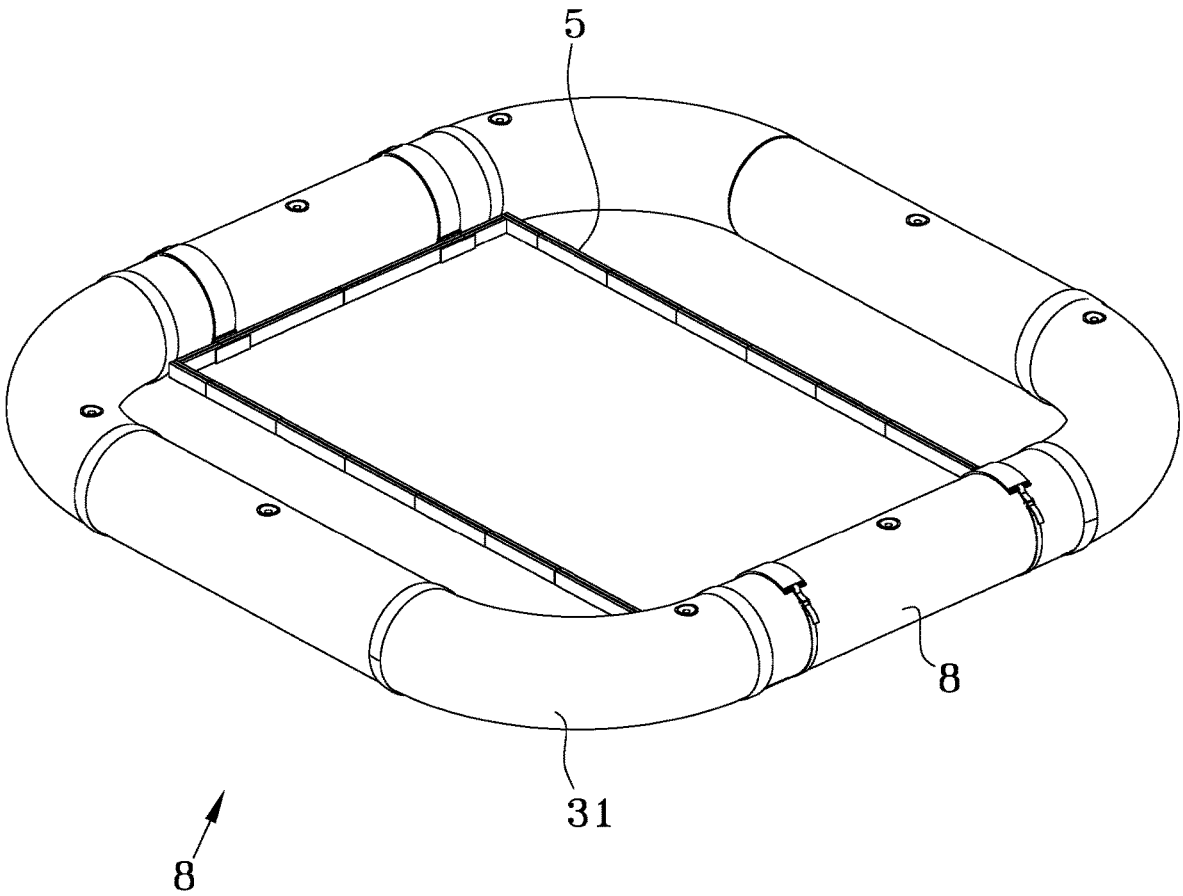
Figure 5:
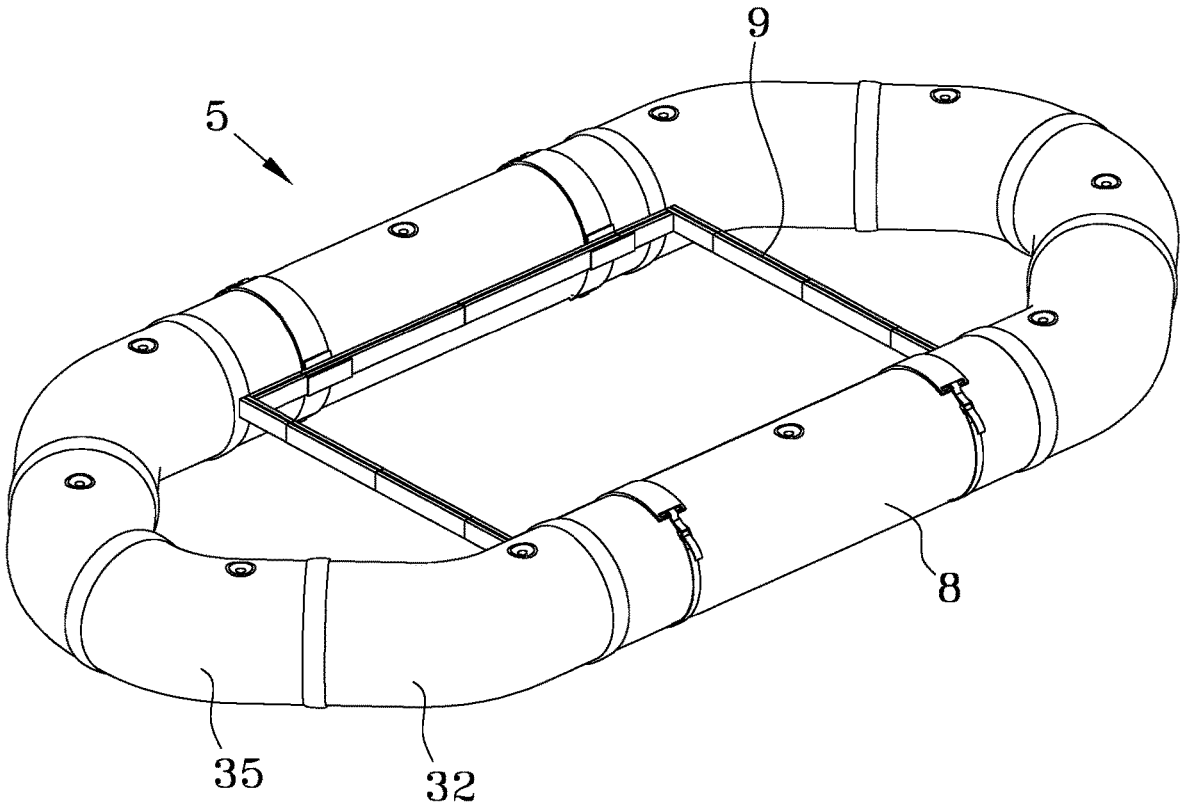

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The present invention relates to a novel design for an inflatable pleasure watercraft system. It is made of an array of differently shaped airtight, polymer, inflatable pontoon tubes ("tubes") that may be mechanically connected by zippers or hook and loop fastener strips at their respective proximal and distal ends, to create any length and style of watercraft. Thus, a person can own one boating system but have multiple different vessels.

When assembled, the watercraft has a configurable, adjustable sized frame assembly made of frame rails joined by frame rail end connectors at their corners and by frame rail Tee connectors along their length between the frame rail ends. The frame itself is collapsible or foldable. The frame assembly is affixed to frame attachment brackets that are mechanically connected at various radial angles on at least four compressive tube clamps that are compressively strapped around the outer diameter of the inflatable tubes. The frame assembly is width and length adjustable and may be removably affixed to the watercraft at various different elevations depending on the intended function of the frame. The frame assembly accommodates specific adaptors to hold different mechanical elements in place about the watercraft such as oars, masts, transoms, motor mounts, floors and seats to name a few. The inflatability of the watercraft's floating structural tubes allows for a lighter weight, and reduced size as compared to equivalent rigid watercraft. The ability to connect any inflatable tube to any other allows for a plethora of floatable vessels such as canoes, rafts, sailboats, sea kayaks, fishing platforms and the like. Most importantly, the vessels that it can create are all compactable for storage and transport.

Figure 6:
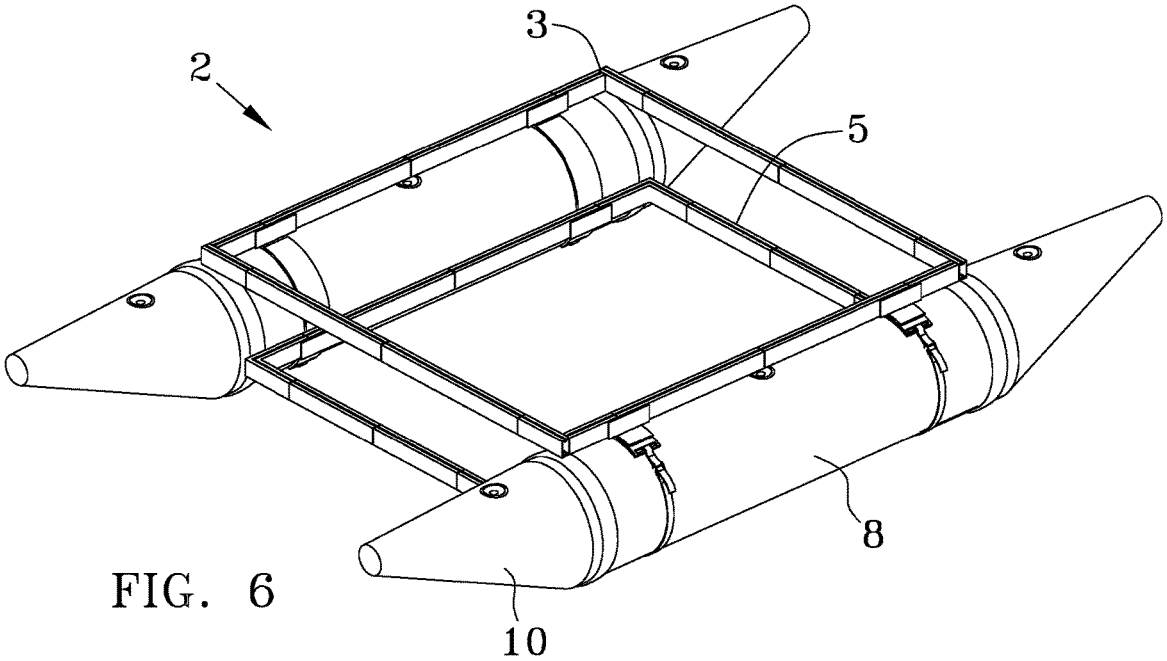
Figure 7:
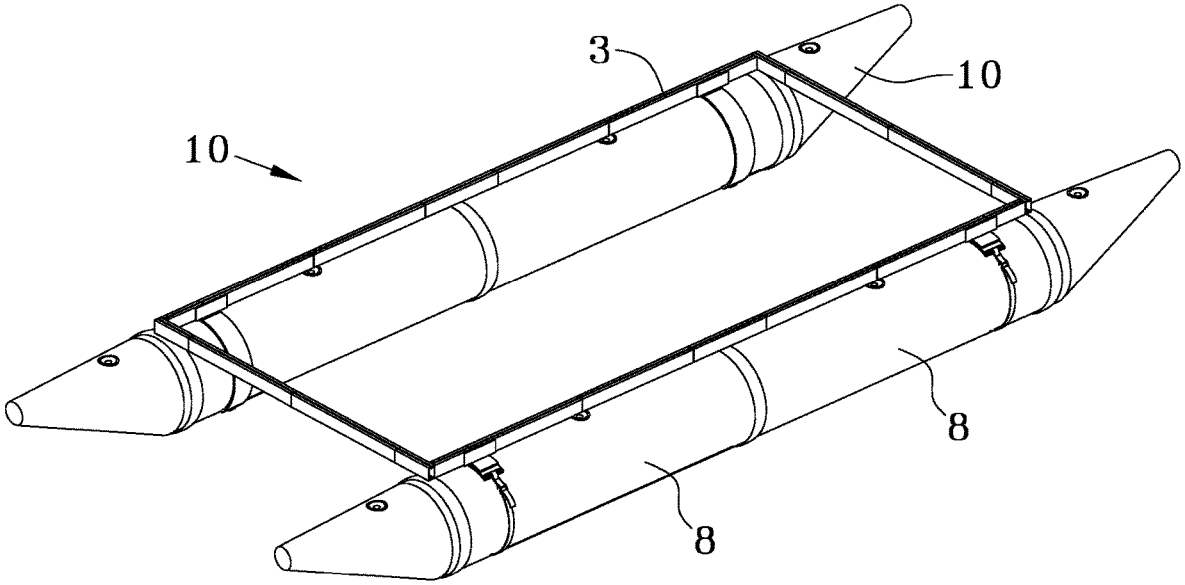
Figure 10:
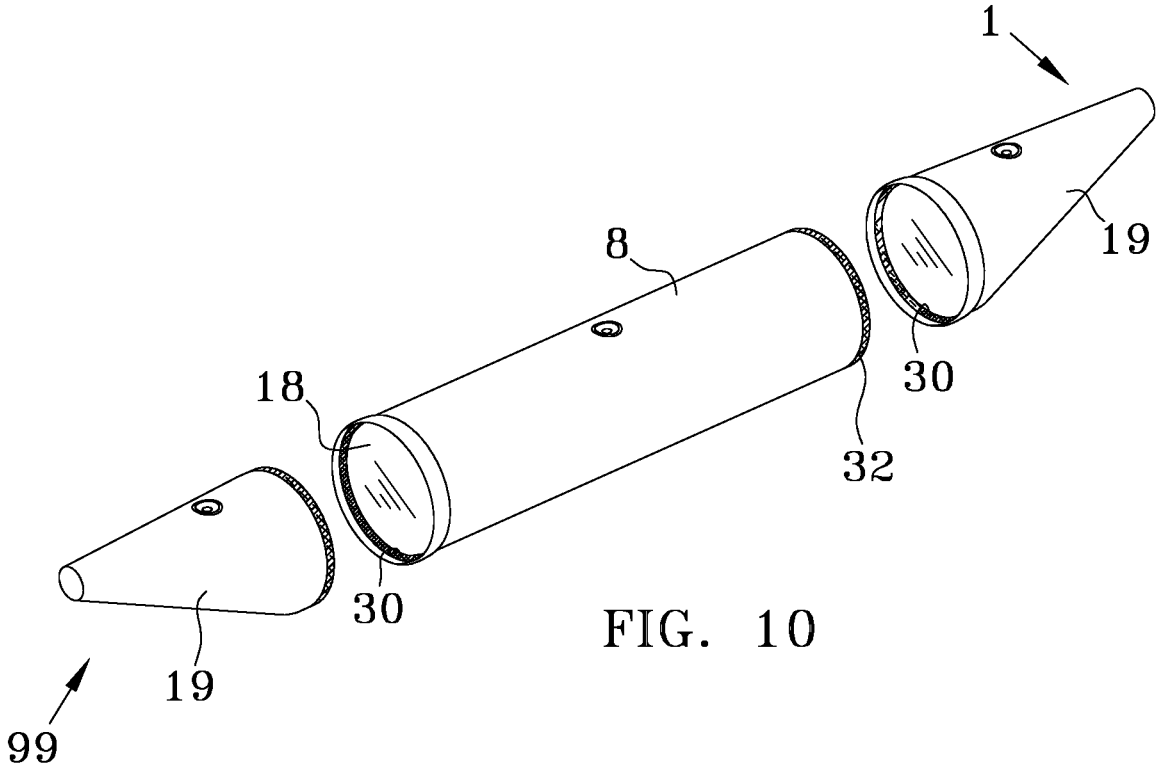
FIG. 10 is a side perspective view of a disassembled hook and loop fastener tube assembly.
Figure 14:
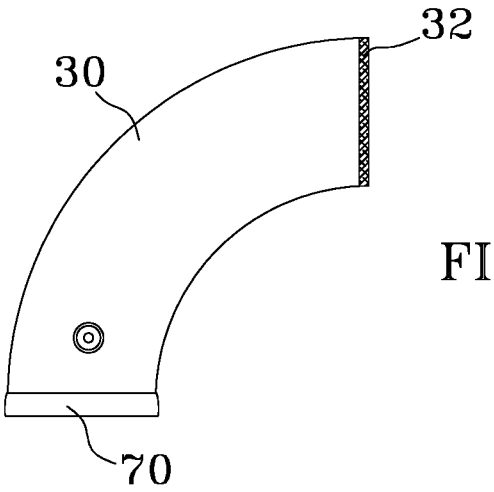
FIGS. 14-16 are top views of various hook and loop fastener corner tubes.
Figure 15:
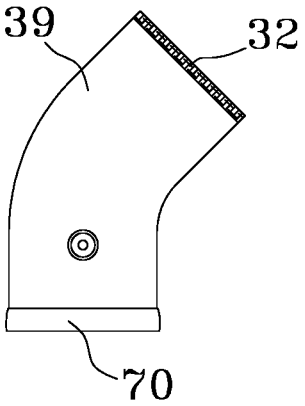
Figure 16:
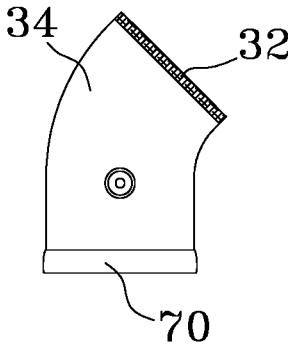
Figure 17:
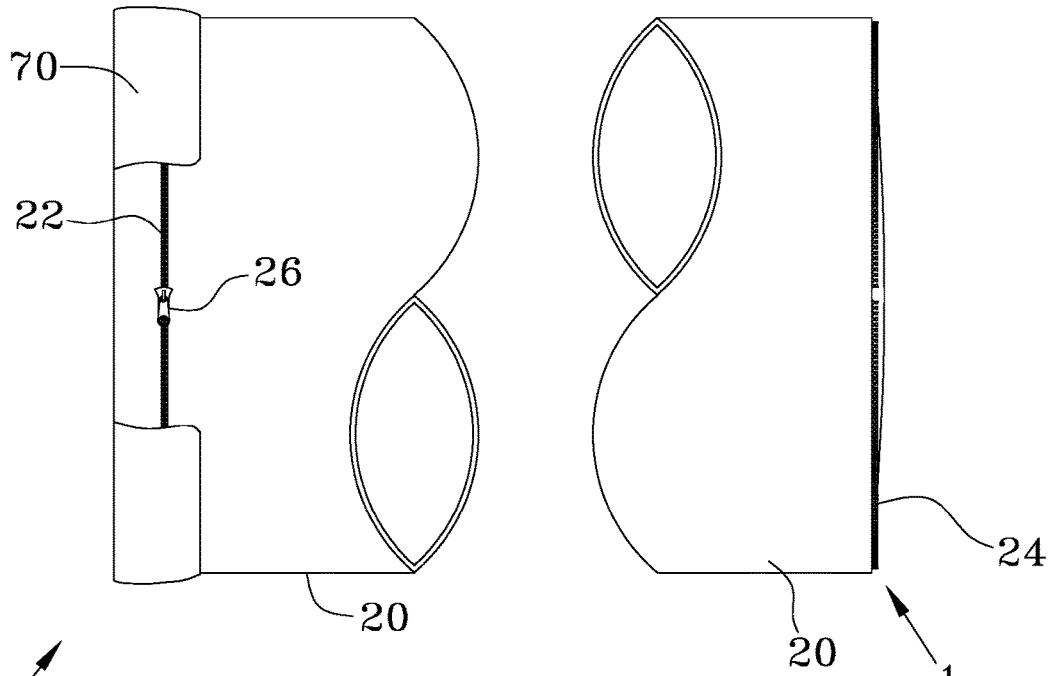
FIG. 17 is a side view of the distal and proximal ends of a zipper side tube.
Figure 18:
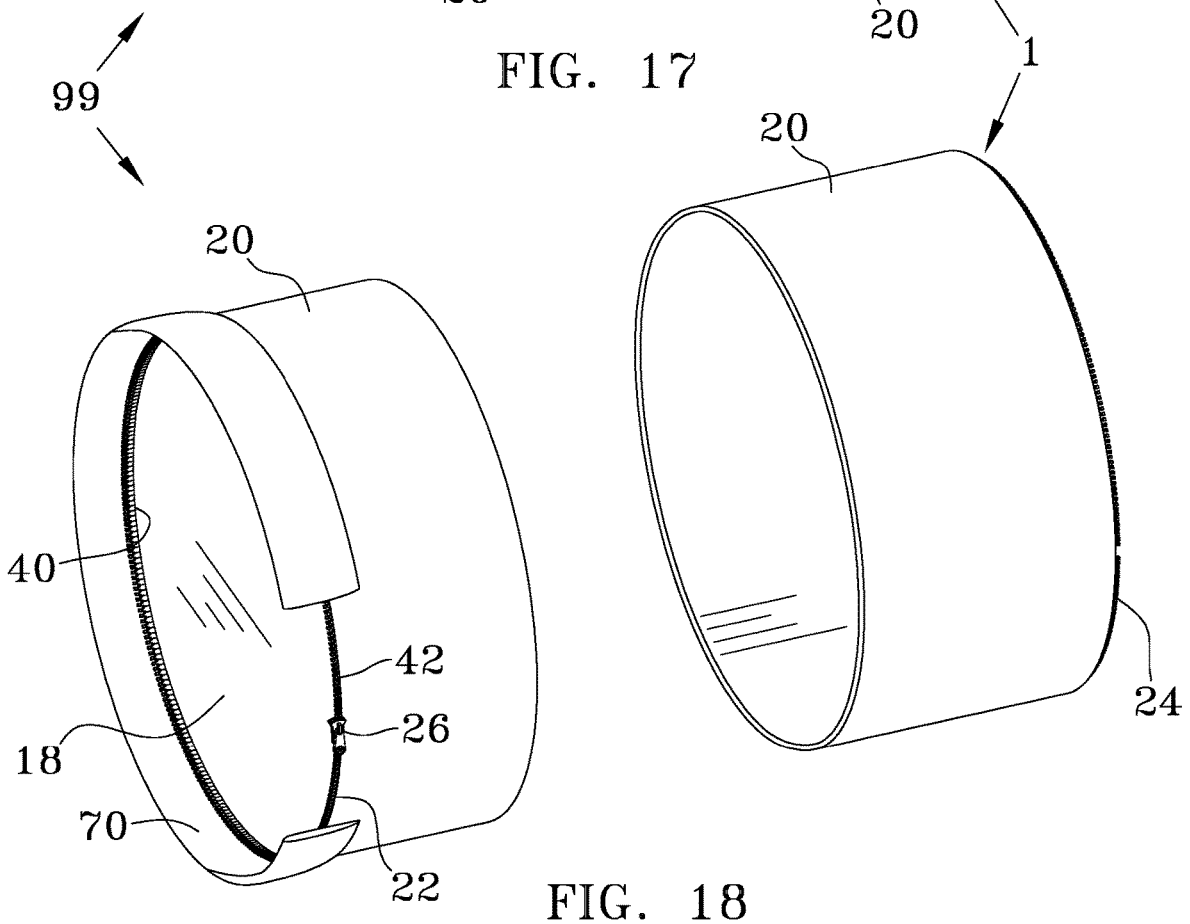
FIG. 18 is side perspective view of the distal and proximal ends of a side tube.
Figure 19:
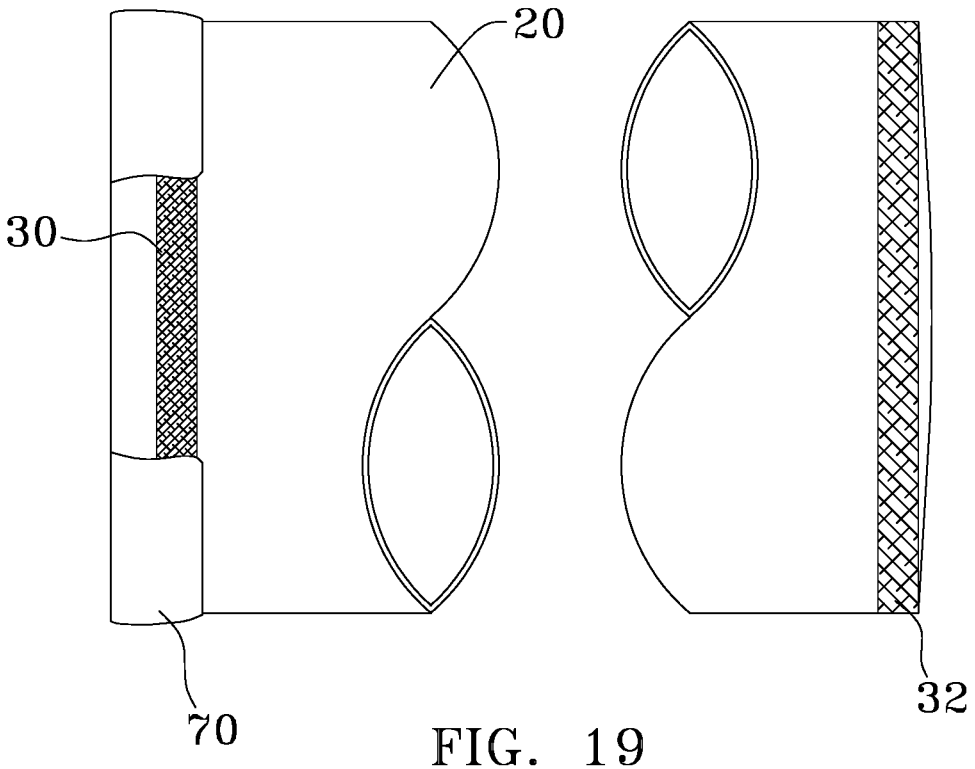
FIG. 19 is a side view of the distal and proximal ends of a hook and loop fastener side tube.
Figure 20:
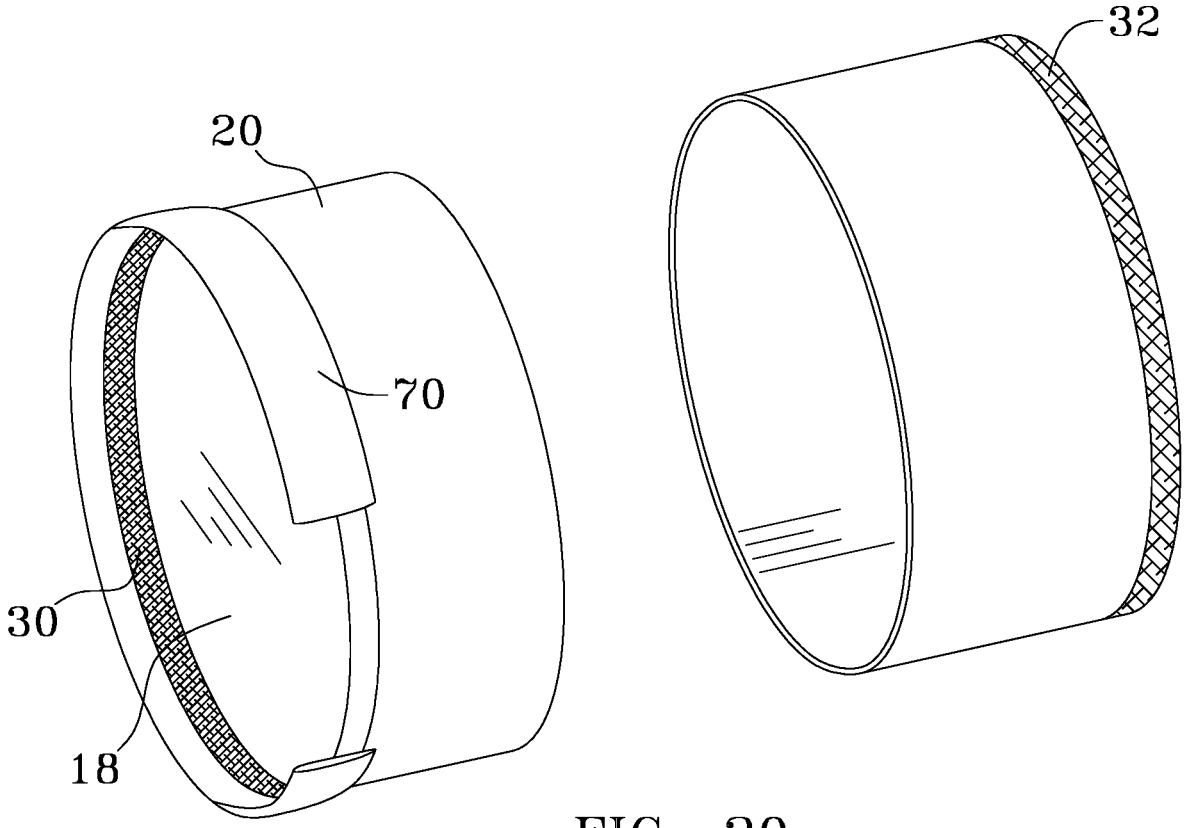
FIG. 20 is side perspective view of the distal and proximal ends of a hook and loop fastener side tube.
Figure 21:
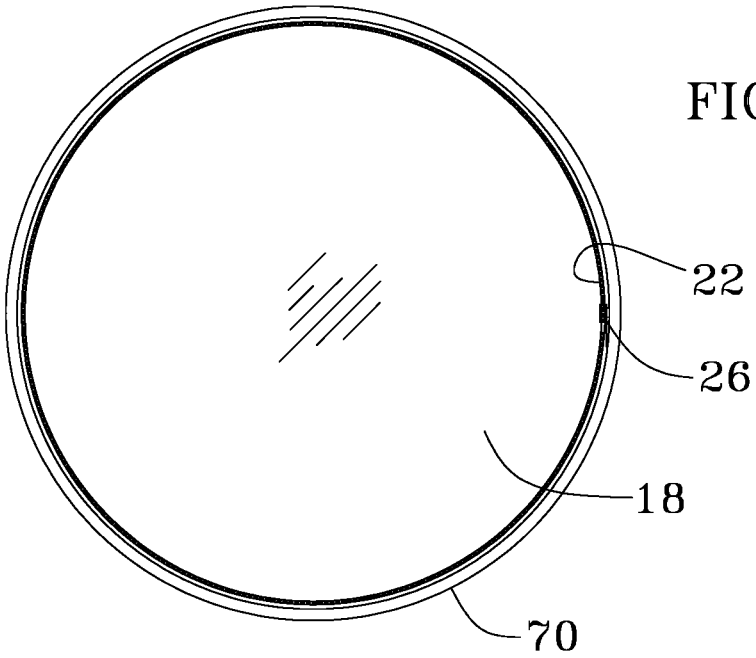
FIG. 21 is a proximal end view of a zipper side tube.
Figure 22:
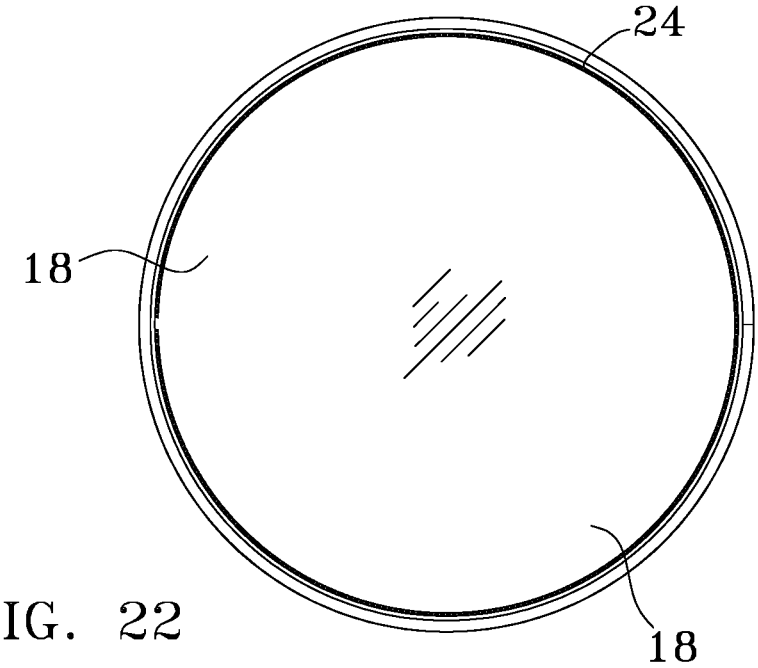
FIG. 22 is a distal end view of a zipper side tube.

Looking at FIGS. 1-7, the expandable inflatable watercraft can be seen assembled into various configurations including a mini pontoon platform 2 with top frame 3, (FIG. 1) an elliptical raft 4 with bottom frame 5, (FIG. 2) a non-elliptical raft 6 with middle frame 7, (FIG. 3) a symmetrical (square) raft 8 with bottom frame 5, (FIG. 4) a non-elliptical raft with a centrally stiffened bottom frame 9, (FIG. 5) a mini pontoon platform 2 with a bottom frame 5 and a top frame 3 (FIG. 6) and a double long pontoon boat 10 with a top frame 3. (FIG. 7)

The various watercraft all utilize their different configurations for different boating functions, and adjust the vertical height of their frame/s depending on whether it is intended for establishing a floor, a rope trampoline or a working platform. In some instances, two frames are utilized where vertical sides may be affixed between the parallel frames, or where the upper frame may be used to support boating related equipment such as trolling motors, oarlocks, sails, BBQ, anchors, buoys and the like.

Figure 24:
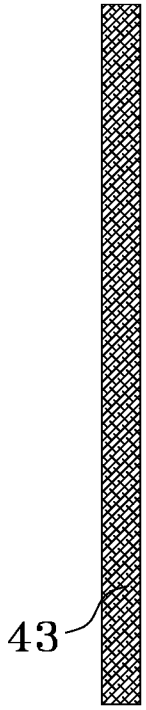
FIGS. 24 and 25 are top views of a hook fastener strip, and a loop fastener strip.
Figure 25:
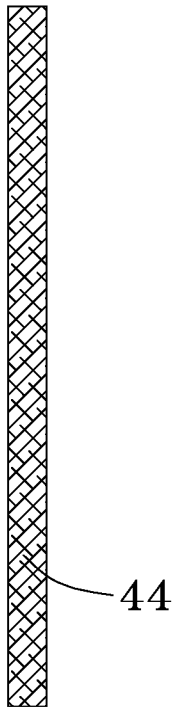
Figure 26:
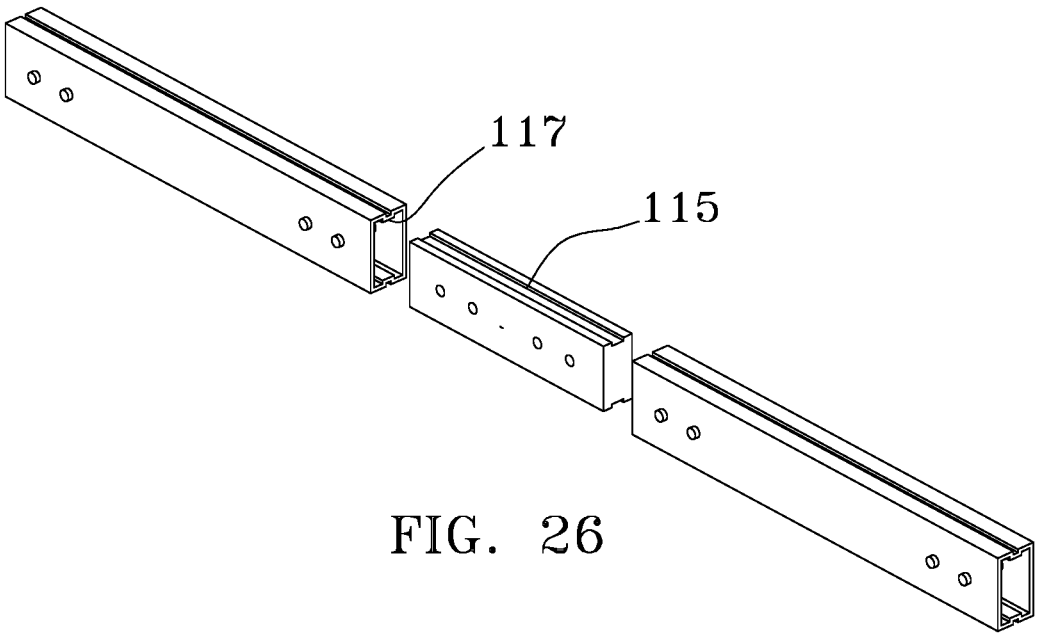
FIG. 26 is a perspective side view of a first embodiment frame rail with connector.
Figure 27:
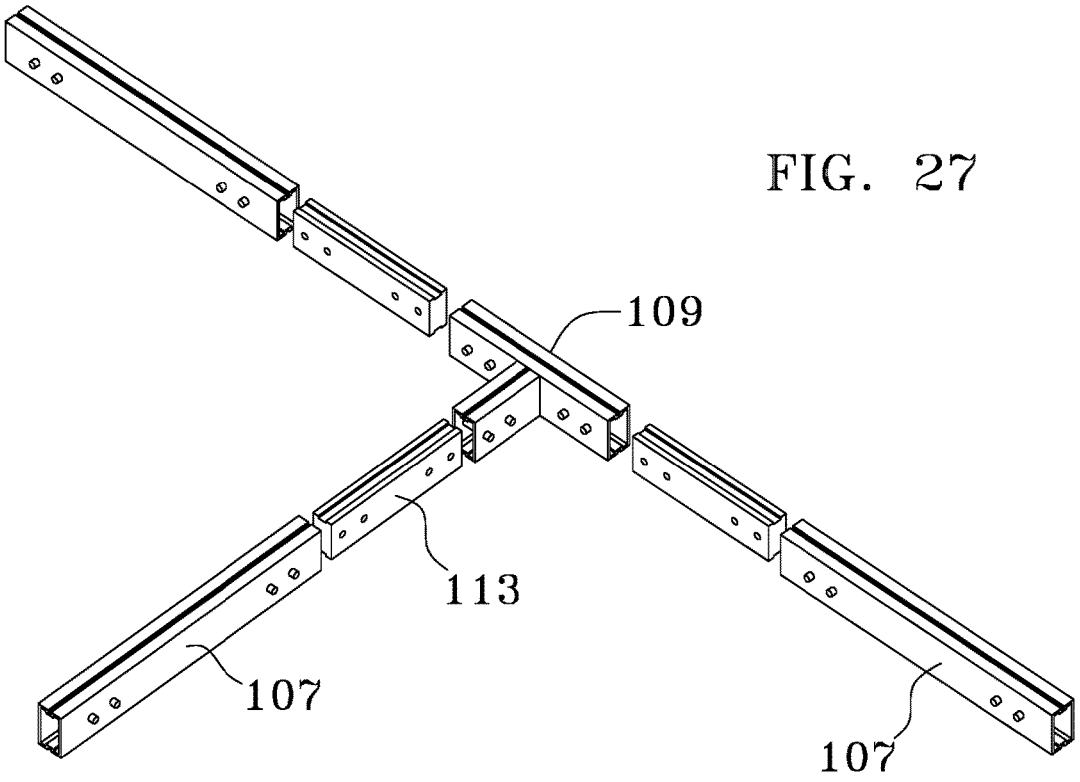
FIG. 27 is a perspective side view of a first embodiment intermediate frame rail assembly.
Figure 28:
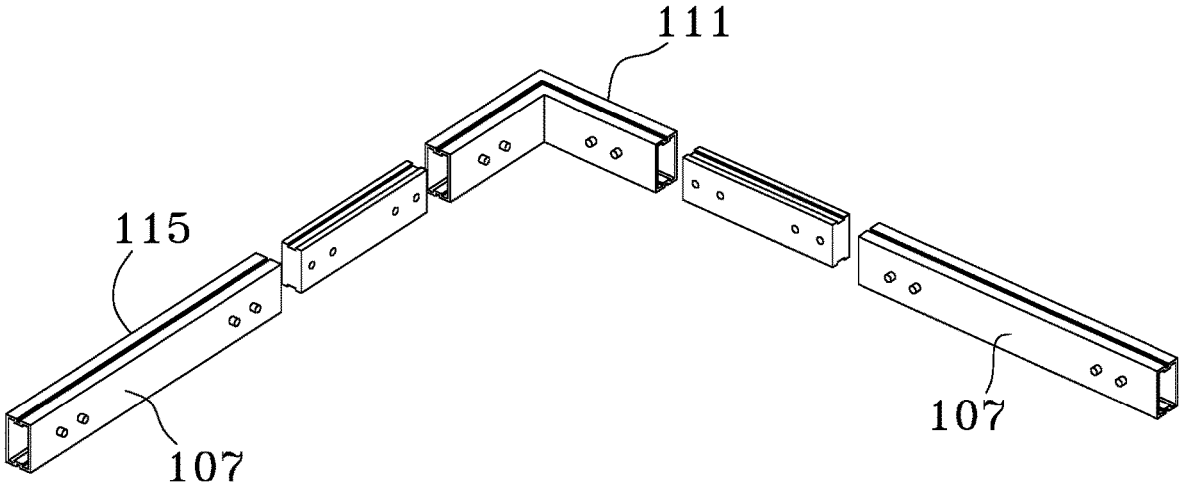
FIG. 28 is a perspective side view of a first embodiment end frame rail assembly.

The various configurations of the expandable inflatable watercraft may use linear arrays of connected tubes as in the case of the pontoon platforms, or may have contiguous connected tube assemblies such as the rafts. Looking at FIGS. 8, 9, 10 and 11 to 16 it can be seen that there are three different types of tubes in both the zippered embodiment and in the hook and loop fastener embodiment. These are linear tubes 8 and 17, conical tubes 10 and 19, and curved tubes including 90-degree tubes 30 and 31, 45-degree tubes 39 and 33 and 15-degree tubes 34 and 35. All of the various tubes have tube walls with circular axial cross sections and circular end panels although the end panels are different diameters in the conical tubes. are connectable at both their ends except the conical tubes 19 and 10 which are only connectable at one end. Although the first zipper half and second zipper half or hook fastener strip and loop fastener strip components are affixed at their specific distal or proximal ends, there is intermediate zipper assembly 40 (FIG. 23), an intermediate hook fastener strip 43 (FIG. 24), and an intermediate loop fastener strip 44 (FIG. 25) that when placed between any two tubes allows either end of any tube to be connected to any end of any other tube.

The linear tubes 8 are airtight, inflatable, polymer, right circular cylinders with zippers or hook and loop fasteners strips affixed at the distal and proximal ends of the tube. These linear tubes are the basic building blocks for any watercraft.

The conical tubes 19 and 10 have only one connectable end to which a zipper of hook and loop fastener strip is attached. These conical tubes 19 and 10 are used to complete both ends of a linear tube or an array of connected linear tubes for either side of a pontoon watercraft.

The curved tubes are configured at common angles, with there being a 90-degree tube 31, a 45-degree tube 33 and a 15-degree tube 35 in the zippered embodiment. In the alternate embodiment, there is a 90-degree tube 30, a 45-degree tube 39 and a 15-degree tube 34 with hook and loop fasteners at their distal and proximal ends. Custom angles and lengths of tubes may be used for specialized configurations. The curved tubes are used to join linear tubes that may reside on the sides and or the ends of the watercraft to make rafts of various sizes and configurations.

FIGS. 17-22 illustrate the details of the distal end 1 and the proximal end 99 of the tubes, specifically the attachment of the zipper, the hook and loop fastener strips, the end panel 18, the side wall 20 and the abrading shield 70. The floating, inflatable watercraft structures all have inflatable, circular cross-section, linear tubes (tubes) of different geometric configurations that are connected to other inflatable tubes at both or one of their ends by zippers or in an alternate embodiment, by hook and loop fastener strips. All tubes have a proximal end 99 and a distal end 1. The zipper connectable ends (and hook and loop fastener strip ends) of all tubes except the conical tube, are generally planar, circular end panels 18, (FIGS. 18, 20, 21, and 22) having a common diameter. The end panels 18 and the abutting tube side wall 20 are perpendicular. The perimeter edge of the end panels 40 are mechanically joined to the perimeter edge of the tube side wall 42 with one half of the zipper therebetween. This interface is sealed by any of a known method of airtight fabric connections. This mechanical joining may be by stitching, welding or gluing followed by airtight seam sealing, via the application of a waterproof, airtight coating application, fabric welding, or overlay of a waterproof sealing tape. (Optionally, a bladder may be used to ensure the tubes can hold air indefinitely.) The zipper portions are arranged in a circle at the interfaces between the perimeter of the end panels 18 and both the perimeter edge of the side wall 20 of the tube. The zipper portion used at the distal end of the tube 1 is matingly engageable with the zipper portion used at the proximal end of the tube 99.

The zippers are affixed to the interior perimeter edge of the distal and proximal ends of the tube's side wall 20 between the tube walls 20 and the panels 18. The first zipper portion 22 and second zipper portion 24 extend perpendicularly from the panel 18 at the proximal and distal ends of each tube. The zippers have a first zipper portion 22 (FIGS. 9, 17, 18 and 21) and a mated second zipper portion 24 (FIGS. 17, 18 and 22) for enmeshed engagement. The first zipper portion 22 has the slider/pull tab assembly 26 slidingly affixed thereon its series of teeth and generally is on the proximal end of a tube 99 covered by the abrading shield 70. The second zipper portion 24 has a series of teeth including a starting tooth at one of its ends and is generally on the distal end of a tube 1. (It is known that the zipper portions are interchangeable between the distal and proximal ends of the tube. For this disclosure, the first zipper portion is assumed to be located at the proximal end of the tube.)

There is an abrading shield 70 over the proximal end of the tube 99 beginning before the interface of the side wall, zipper and end panel, and that extends over the first zipper portion 22. There is no such abrading shield 70 at the distal end of the tube 1. The abrading shield 70 protects the zipper teeth and also prevents the abrasion of the zipper teeth on tubes and humans. This shield may be created in different ways. It may be affixed as a separate collar that is affixed over and beyond the proximal end of the tube's side wall 99, or it may be the end of the side wall that is folded back (mechanically hemmed) onto itself, and then joined to the zipper and the panel 18.

In the alternate embodiment, one portion of the hook and loop fastener is sandwiched between the perimeter edges of the tube side wall and the perimeter edge of the edge panels, and these three elements stitched together such that the hook fastener portion 30 or loop fastener portion 32 of the hook and loop fastener strip (FIGS. 10, 19 and 20) extend perpendicularly from the plane of the end panel 18. The hook and loop fastener portion used at the distal end of the tube is similarly affixed to the tube at the interface of the end of the tube side wall and the perimeter of the end panel. It is matingly engageable with the hook and loop fastener portion used at the proximal end of the tube.

In another alternate embodiment (not illustrated), one portion of the hook and loop fastener strip is affixed to the inner face of the abrading shield and the complimentary hook and loop fastener strip is affixed around the outer perimeter of the tube side wall. In this embodiment, the abrading shield 70 is peeled back onto the tube toward the distal end 1 and then rolled forward toward the proximal end to engage its complimentary engaging counterpart when the distal end of another tube abuts the proximal end. In this design the hook and loop fastener strips need not be sandwiched between the end of the tube and the perimeter of the end panels.

Discussing the various configurations of the expandable inflatable watercraft of FIGS. 1-7, it can be seen that the mini pontoon platform 2 has two substantially similar tube assemblies. Each of these tube assemblies has a linear tube 8 with a first conical tube 10 connected at its proximal end 99 and a second conical tube 10 connected at its distal end 1. (FIGS. 8-10) These conical tubes 10 differ in their zipper (and their hook and loop fastener strip) configurations. One of the conical tubes 19 has a second zipper portion 24 (for attachment to the first zipper portion 22 at the proximal end of the linear tube 8) and the other conical tube 19 has a first zipper portion 22 (for attachment to the second zipper portion 24 at the distal end of the linear tube 8). (See FIG. 9)

Figure 23:
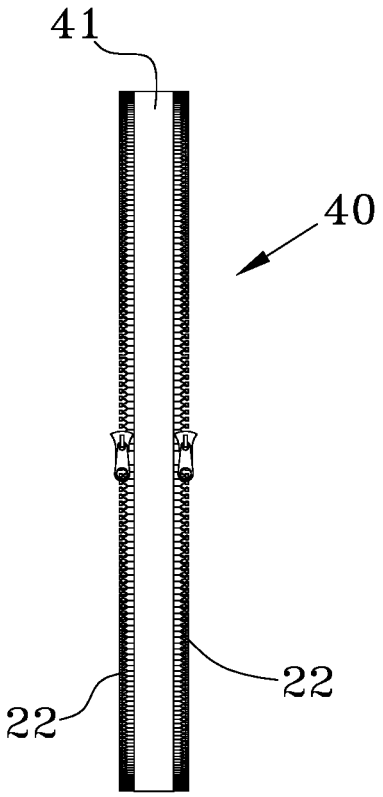
FIG. 23 is an intermediate zipper assembly.

As discussed herein, the tubes would be directional with only one end of any tube connectable to one end on another tube. However, situations arise wherein it is preferable to connect like ends of tubes or wherein a single connector tube (like the conical tube) is to be attached to both the proximal and distal end of a tube. This is accomplished using the intermediary zipper assembly 40 (FIG. 23). This has identical first zipper portions 22 held in a parallel configuration on either of the side edges of a fabric backer strip 41. Essentially this converts a second zipper portion 24 into a first zipper portion 22. In a similar scheme, there is a double wide loop fastener strip 43 (FIG. 24) and a double wide hook fastener strip 44 (FIG. 25) that may be matingly engaged with their complimentary fastener strip to reverse the connectivity of hook and loop fastener tubes.

Thus, there is another way to create the mini pontoon platform 2 using only identically configured conical tubes 10. One side of an intermediary zipper assembly 28 is affixed to the second zipper portion 24 at the distal end of the conical tubes 10. This allows any second zipper portion 24 to be converted into a first zipper portion 22 capable of connection to a second zipper portion 24. Use of this intermediary zipper assembly 40 along with different zipper portions on the different ends of each tube allows any tube to be connected to any other tube. Here, the intermediary zipper assembly 40 is connected to the second zipper portion 24 at the distal end of the linear tube 8 allowing the first conical tube 10 to be adjoined to the distal end of the linear tube 8. The other first conical tube's second zipper portion is adjoined to the first zipper portion 22 at the proximal end of the linear tube 8.

Looking at the elliptical raft 4 (FIG. 2) in comparison to the non-elliptical raft 6 (FIG. 3), one can see that while there are striking similarities, they are constructed using different combinations of corner tubes. The elliptical raft 4 has two linear tubes 8 connected at each of their ends to a 90-degree tube 31 (FIG. 11) who's respective ends are zippered together.

The non-elliptical raft 6 (FIG. 3) has two linear tubes 8 each connected at both of their ends to a long 60-degree tube 33 (FIG. 12) each of which has its other end connected to one end of a short 15-degree tube 35 (FIG. 13) that has its remaining end zippered to the remaining end of the other short 15-degree tube 35.

The square raft 8 (FIG. 4) has four linear tubes 8 jointed at either of its ends to 90-degree tubes. It is assembled without the need for any intermediary connectors.

The mini pontoon platforms 2 of FIGS. 1 and 6 differ only by the attachment different frames. One has a bottom frame 5 and a top frame 3 (FIG. 6) whereas one only has a top frame 3. (FIG. 1) The double long pontoon boat 10 (FIG. 7) incorporates and additional pair of linear tubes 17 into a mini pontoon platform 2.

It is to be noted for connective continuity in each of these raft configurations, the two linear tubes are oriented 180 degrees from each other such that one linear tube's distal end faces the rear of the raft while the other linear tube's proximal end faces the rear of the raft.

Figure 30:
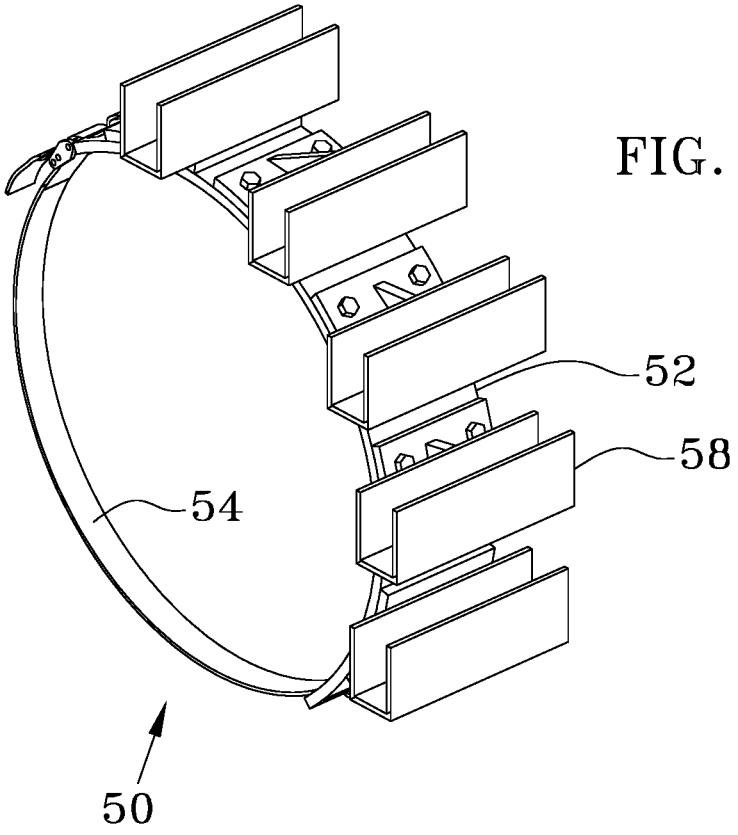
FIGS. 30 and 31 are perspective side views and end views of the frame attachment assembly.
Figure 31:
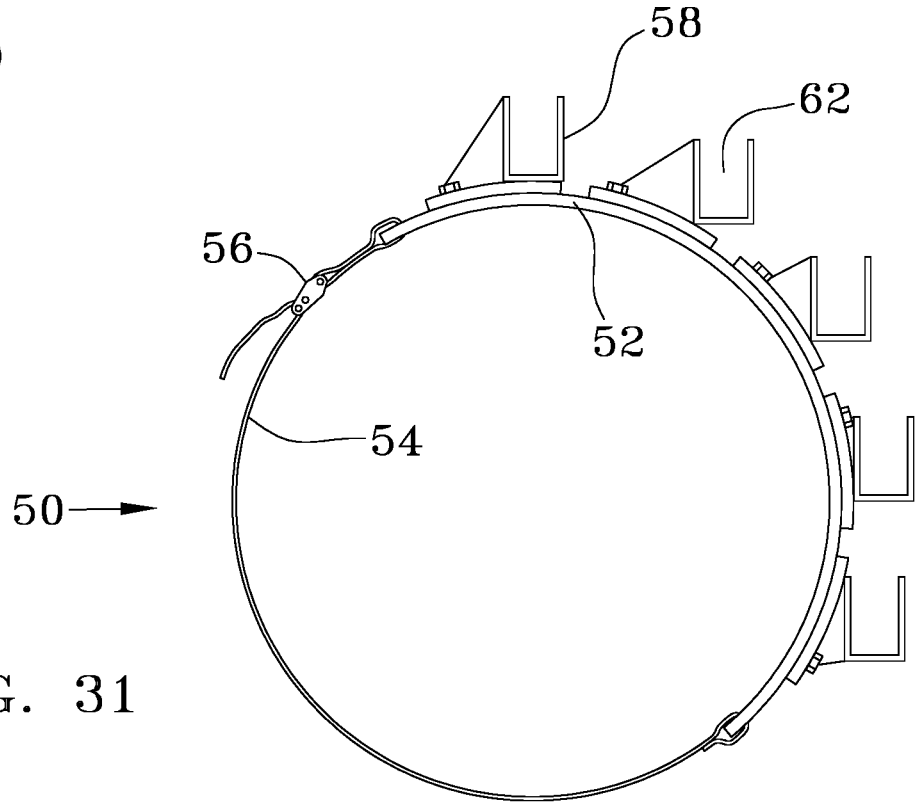

The various watercraft all have height adjustable, sizeable frames affixed at different heights onto the linear tubes 8. These frames are affixed to the tubes by an adjustable compressive tube clamp 50 (FIGS. 30 and 31). The compressive tube clamp 50 has a curved plate 52 with an adjustable belt 54 connected between its two ends. The adjustable belt 54 is permanently affixed to one end of the curved plate 52 and is length adjustably connected to the other end of the curved plate. The radius of the arc of the curved plate 52 is substantially similar (or slightly smaller) to the cross-sectional radius of an inflated linear tube 8. The curved plate 52 is placed on the outer side wall 20 of a linear tube 8 and the non-fixed end of the belt 54 is threaded through its complementary buckle assembly 56 and drawn taut to cinch the compressive tube clamp 50 around the linear tube 8 for frictional engagement. The compressive tube clamp 50 should be drawn into frictional engagement about the side wall 20 such that it slightly buckles the linear tube inward and compresses the tube's diameter in that localized region beneath the compressive tube clamp 50. This will prevent any lateral movement of the compressive tube clamp 50 along the length of the tube.

Figure 32:
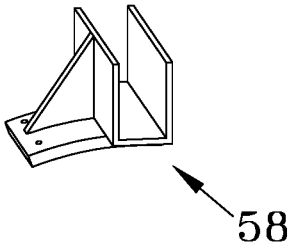
FIGS. 32-36 are end perspective views of the frame connectors.
Figure 33:
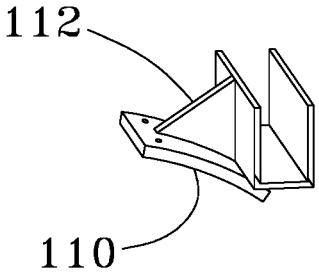
Figure 34:
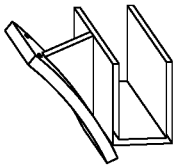
Figure 35:
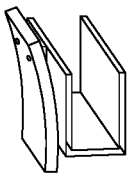
Figure 36:
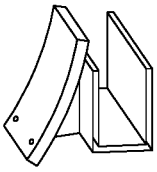
Figure 37:
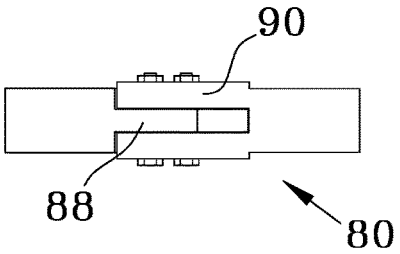
FIGS. 37-40 are top, side perspective, side and end views of the third embodiment frame rail connector.
Figure 38:
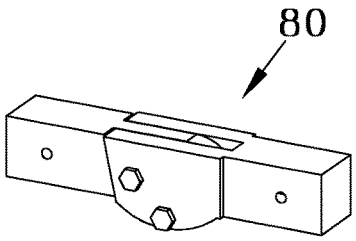
Figure 39:
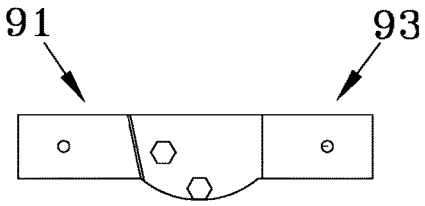
Figure 40:
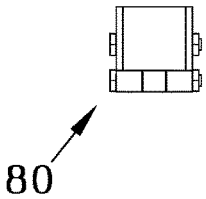
Figure 41:
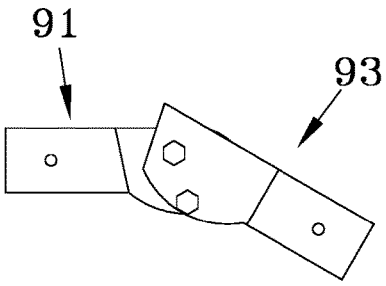
FIGS. 41-43 are top views of the third embodiment frame rail connector shown in three angled positions.
Figure 42:
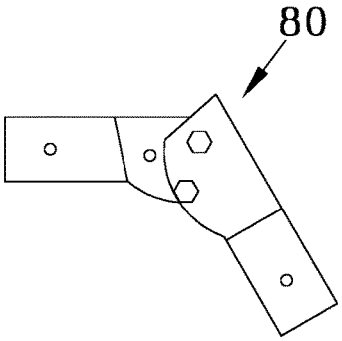
Figure 43:
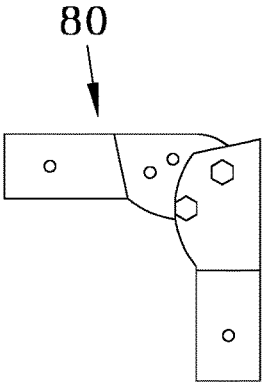
Figure 44:
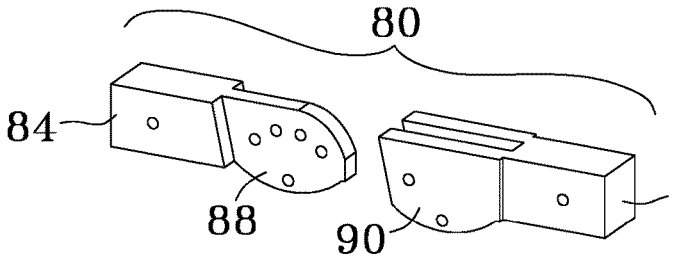
FIG. 44 is an exploded view of the third embodiment frame rail connector.

On the compressive tube clamp 50 there is at least one frame mount 58 (FIGS. 32-36) that is sized to accommodate the frame rails of the assembled frame. Although depicted in FIGS. 31 and 32 as the compressive tube clamp 50 having five different frame mounts 58 affixed at different radial positions to the curved plate 52, this is for illustrative purposes only as generally there will be but one or possibly two frame mounts used per compressive tube clamp 50. The frame mounts 58 are mechanically attached to the compressive tube clamp 50 by bolts passing through orifices in the compressive tube clamp and the frame mounts.

Each frame mount 58 has a frame rail cradle 62 sized to accept the frame rails. The frame rail cradle 62 is connected to its arc base 110 by a gusset 112. The frame mounts 58 differ in the angle of their frame rail cradle 62 with respect to the arc of the curved plate 52. This allows for the different vertical placements of the frame assembly around the tubes. (FIGS. 32-36 show the different angles utilized.) The mechanical connection between the frame assembly and the compressive tube clamp 50 occurs in the frame rail cradle 62. Generally, this is by lockable pins although orifices in the frame rails 50 and the frame rail cradle 62. However, there is a plethora of different mechanical connectors that could be used such as devises, spring buttons, bolts, rings, pins and the like as is well known. In one embodiment, an angle adjustable, single frame mount may be used. In other embodiments, different fixed angle frame mounts 58 may be utilized to accommodate retaining the frame rails at different elevations (radial locations) about the linear tube 8. The angle adjustable, vertically adjustable, single frame mount may be affixed at any of a series of fixed, different locations at different vertical positions on the curved plate 52 by mechanical connectors. With a single frame mount 58, it is angle adjustable such that the frame rail cradle 62 may be maintained in a horizontal orientation. The difference in the heights of the frame assemblies on the watercrafts are a result of different frame mount locations on the compressive tube clamp 50 is illustrated in FIGS. 1-7.

Figure 45:
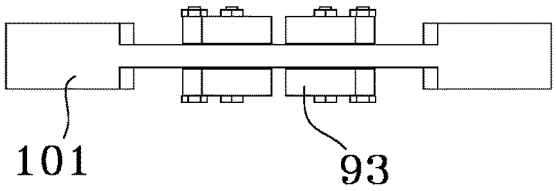
FIGS. 45-48 are top, side perspective, side and end views of the third embodiment double frame rail connector.
Figure 46:
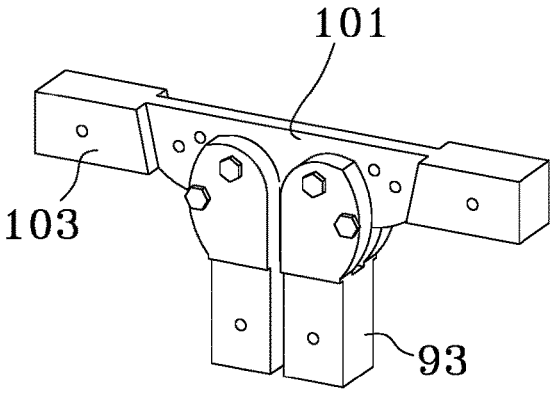
Figure 47:
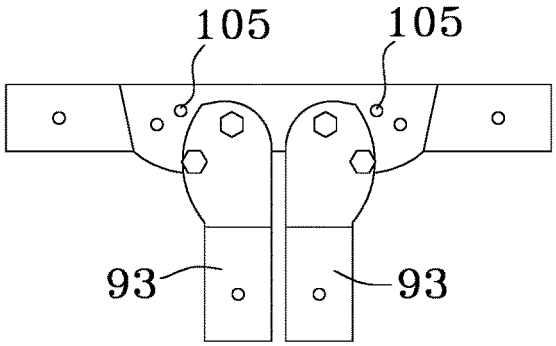
Figure 48:
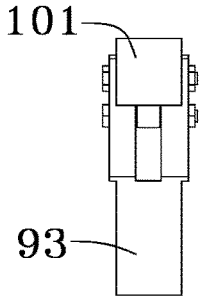
Figure 49:
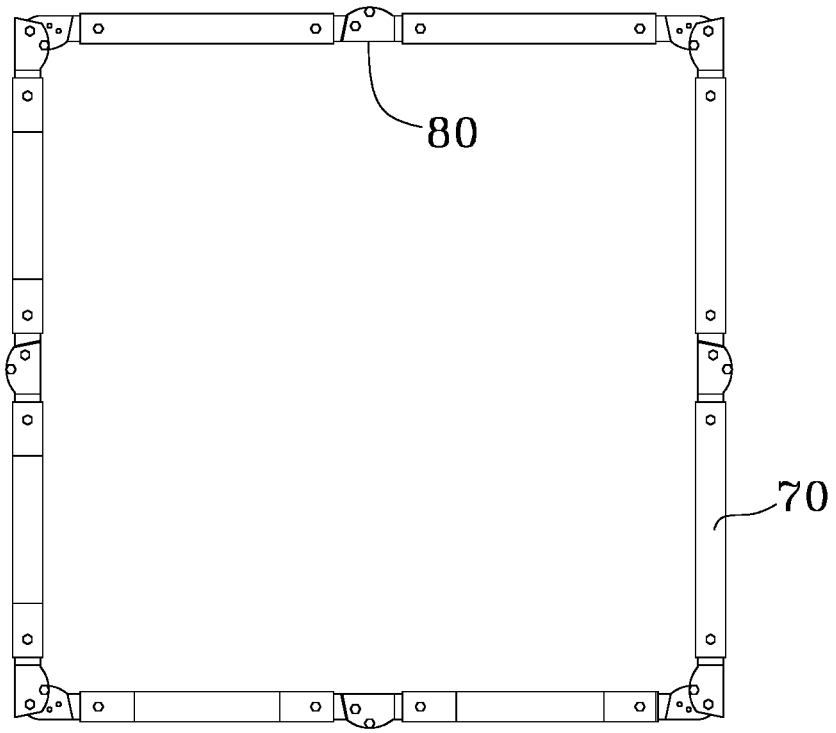
FIG. 49 is a top view of a third embodiment frame.
Figure 50:
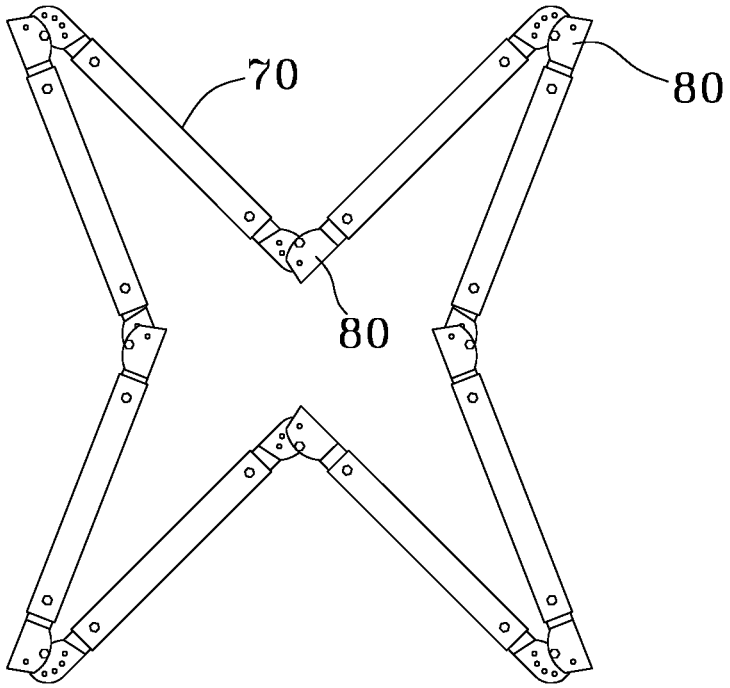
FIG. 50 is a top view of a folded third embodiment frame.
Figure 51:
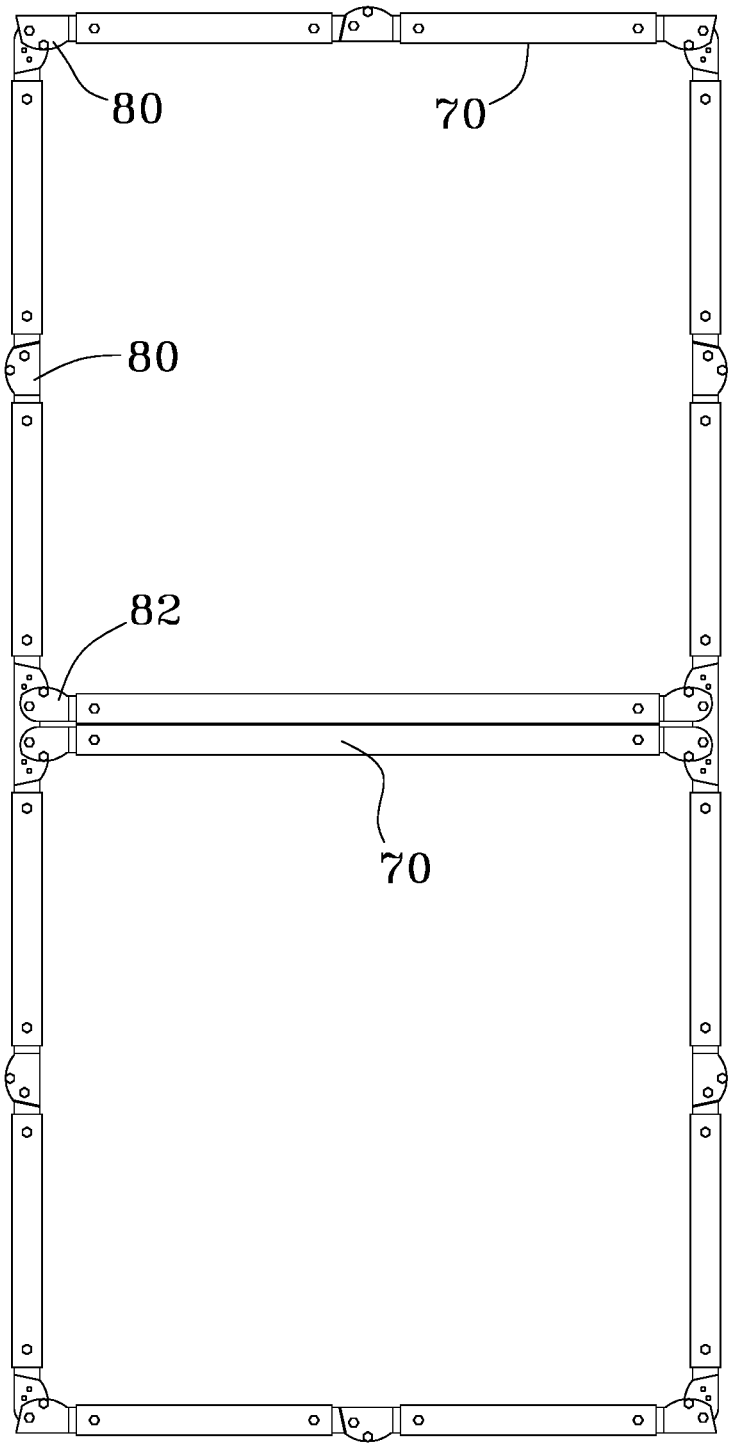
FIG. 51 is a top view of a third embodiment double frame.

There are two different frame assemblies. The frame rails are linear and have two identical ends. In the preferred embodiment frame assembly (FIGS. 37-51) square tubing is used as the linear members that form the frame rails 70. Square tubing is readily available in a plethora of materials. The only modification over conventional tubing is the inclusion of orifices that allow for mechanical fasteners to connect the frame rails 70 to the tubing connectors. There are two different types of connectors for the preferred embodiment frame assemblies, a single connector 80 (FIGS. 37-44 and 49-51) and a double connector 82 (FIGS. 45, 48 and 51). Single connectors 80 are used for corners of frame assemblies and where frame rails 50 may need to be coupled in a linear fashion to lengthen the watercraft.

The single hinge connector 80 is a two-piece hinge assembly. (FIGS. 37-44) The male hinge half 91 has a first square socket 84 (sized to accommodate the square frame rails 70) with a planar first leaf 88 extending normally therefrom. The female hinge half 93 has a second square socket 86 (also sized to accommodate the ends of the frame rails) with a pair of parallel and opposing second leaf's 90 extending normally therefrom. The spacing between the second leaf 90 approximates the thickness of the first leaf 88 to accommodate pivoting movement between the two hinge halves about their mechanical fastener. The male hinge half 91 is positionally locked with its female hinge half 93 by a pair of mechanical fasteners (preferably a bolted and or pined assembly) passing through two orifices in the female hinge half 93 which are aligned with a select two orifices in a series of orifices in the male hinge half 91 so as to lock the angle of the single hinge connector 80. (FIGS. 39, and 41-43 show the various angles attainable.) The pivoting movement between the two hinge halves is accommodated by the removal of one of the mechanical fasteners coupling the two hinge halves. This pivotable coupling allows for the folding of the frame assembly for transport and storage as depicted in FIG. 50. Locking the single hinge connector at 90 degrees forms corners and locking it at 180 degrees allows multiple frame rails 70 to be coupled to lengthen the frame assembly. The single hinge connector 80 may also be affixed with the mechanical fasteners into other than 90 and 180 degree configurations thus allowing the frame to take other than rectangular shapes.

The double hinge connector 82 is also a hinge (a double hinge) but it is a three-piece assembly. (FIGS. 45-48) It has a has a male base leaf 101 where a first planar leaf resides between two opposing square sockets 103 105. Each square socket engages the square ends of the frame rails. The male base leaf 101 has two series of orifices for the angular connection of the male base leaf to the two female hinge halves 93. The female hinge halves 93 in the single hinge connector 80 and the double hinge connector 82 are indistinguishable. The double hinge connector 82 is used to stabilize long frame assemblies by allowing two cross members to be connected between the outside frame rails. (FIG. 51)

Although depicted as having square sockets on the ends of the single and double hinge connectors and the linear frame rails being square in cross section, it is known that circular or rectangular tubing linear frame rails with hinge connectors having round or rectangular cross sectional sockets would be equivalents. Although if round pipe or tubing is used, there will have to be a radial angle locking mechanism on the sockets to rigidly affix the connectors to the frame rails as is well known in the field.

Since the preferred embodiment frame assembly utilizes square frame rails 70, the connectors (single of double) may be installed so as to pivot in the plane of the frame or perpendicular to it. This is handy when trying to stabilize multiple vertical layers of frame assemblies.

Figure 29:
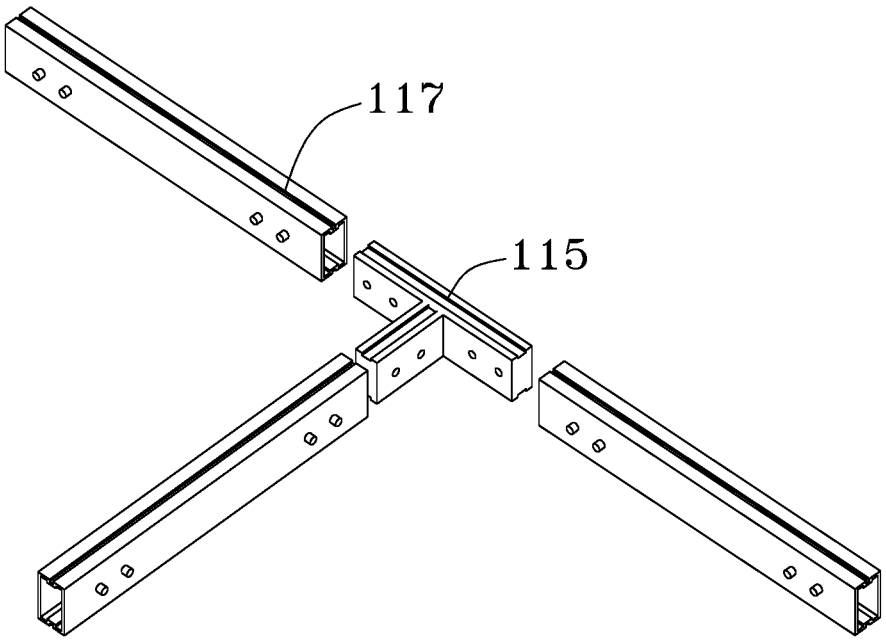
FIG. 29 is a perspective side view of a second embodiment intermediate frame rail assembly.

In the second embodiment, the frame assembly is made of linear rail members 107, T connectors 109, end connectors 111, and internal connectors 113. (FIGS. 26-29) These also utilize mechanical connectors to pass through aligned orifices in these frame rail components that are well known in the industry. The preferred shape is rectangular and with all components having an alignment slot 115 or alignment tab 117 formed on their top faces. (FIG. 29) The T connectors 109, end connectors 111, and internal connectors 113 may slidingly engage over the linear rail members 107 or within them.

It is to be understood that this watercraft can be tailored for numerous water activities and there are countless accessories that may be affixed to their frames. These include floors, masts, sails, motor brackets, outriggers, anchor ties, mooring cleats, light brackets, fish-finder/depth-finder brackets and the like.

It is to be understood that the air retention capabilities of pontoon tubes are well known in the art and is not part of this patentable invention. The various shapes and configurations of the pontoon tubes disclosed herein may be of the bladder or bladderless designs. Although not illustrated a trimaran style raft with two sides and an intermediate linear assembly is also possible.

There are however, certain commonalities in features and structure for all the watercraft assemblies. All tubes are inflatable and airtight. All assemblies are symmetrical about their linear centerline. The minimum number of tubes per watercraft is two. All assemblies have at least two identical opposing sides. All assemblies require at least two compressive tube clamps per side, per frame. All tubes have circular cross sections taken at any point along their linear axis. All tubes have an identical diameter circular cross section where they connect. All cylinders are connectable at a least one end. All frames are symmetrical about their longitudinal centerline. All assemblies can be made any length and any width. Any tube in the set can be connected to any other tube in the set at any of their connectable ends by their existing zipper portion or by using an intermediate zipper between their existing zipper portions. All tubes have at least one abrading shield at an end that extends beyond the zippers. The zipper is sandwiched between the tube side wall and the end panel and extends beyond the tube end for all tubes. All compressive tube clamps accommodate variable locations for the mounting of the frame mounts. All frames are made of linear frame rails connected at their ends by single or double hinge connectors to form corners or intermediary cross brace attachment points. The linear frame rails are square in cross section allowing the hinge connectors to be installed so as to hinge in any of the four planes of the four sides of the linear rails. All linear tubes, curved tubes or conical tubes used in the construction of any watercraft will be used in even numbers.

While certain features and aspects have been described with respect to exemplary embodiments, one skilled in the art will recognize that numerous modifications are possible. System components described according to a particular structural architecture may be organized in alternative structural architectures. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents.

Having thus described the invention, what is claimed as new and desired to be secured by Letters Patent is as follows:

1. A recreational watercraft assembled from modular components, comprising:

at least two inflatable tubes each having a circular cross section and wherein said inflatable tubes are selected from the group consisting of linear tubes and curved tubes:

at least two vertically adjustable, compressive tube clamps, frictionally affixed axially around each of said tubes;

at least four frame mounts, each affixed to one of said tube clamps;

at least four linear frame rails each having two identical ends;

at least four frame connectors;

wherein said frame rails are connected by said frame connectors inserted in said ends of adjacent said frame rails to form a planar frame assembly;

wherein said frame assembly is affixed to said at least four frame mounts to make said recreational watercraft, wherein said recreational watercraft is symmetrical about a longitudinal centerline; and wherein said linear tubes and said curved tubes comprise:

a tube side wall with a proximal end, a distal end and a circular cross section;

a circular, proximal end panel with a circular peripheral edge affixed at said proximal end of said tube side wall;

a circular, distal end panel affixed at said distal end of said tube side wall;

a first zipper portion affixed between said proximal end of said tube side wall and said peripheral edge of said proximal end panel, said first zipper portion extending beyond said tube side wall;

a second zipper portion affixed between said distal end of said tube side wall and said peripheral edge of said distal end panel, said first zipper portion extending beyond said tube side wall;

an abrading shield affixed at said proximal end of said tube side wall, said abrading shield extending over said first zipper portion; and wherein said first zipper portion and said second zipper portion are meshingly engageable.

2. The recreational watercraft of claim 1 wherein at least one of said frame connectors is a first hinge connector and comprises:

a male hinge half having a first square socket sized to accommodate said ends of said frame rails and a planar first leaf extending normally therefrom;

a female hinge half with a second square socket sized to accommodate said ends of said frame rails and with a pair of parallel and opposing second leaves extending normally therefrom said second square socket;

at least one of a mechanical connector;

wherein said first leaf frictionally fits between said parallel and opposing second leaves and said at least one mechanical connector joins said male half hinge and said female half hinge; and wherein said male hinge half and said female hinge half pivot about said mechanical fastener.

3. The inflateable watercraft of claim 2 wherein at least one of said frame connectors is a second hinge connector and comprises:

a male base leaf with a first planar leaf residing between two identical, opposing first square sockets sized to accommodate said ends of said frame rails;

two identical female hinge halves, each with a second square socket sized to accommodate said ends of said frame rails and with a pair of parallel and opposing second leaves extending normally therefrom said second square socket;

at least two mechanical connectors;

wherein said male base leaf frictionally fits between said parallel and opposing second leaves of both female hinge halves, and one of said mechanical connectors joins said male base leaf and each of said female half hinges; and wherein said male hinge half and each of said female hinge halves pivot about said mechanical fastener.

4. The recreational watercraft of claim 1 further comprising:

four inflatable conical tubes each having a conical longitudinal configuration with a large end, a small end and a tapered tube side wall therebetween;

each of said conical tubes having a zipper portion selected from the set consisting of first zipper portions and second zipper portions, said zipper portion affixed to said large end of said conical tube;

wherein each said conical tube is connected at said large end to said proximal end or said distal end of said linear tube by engagement of its zipper portion.

5. The recreational watercraft of claim 1 wherein said tube clamps are comprised of:

a curved plate having a first end and a second end;

an adjustable belt affixed to said first end and adjustably affixed to said second end by a buckle assembly;

a series of orifices to accommodate mechanical fasteners to attach said frame mounts to said curved plate;

said curved plate having a radius the same as a radius of said circular cross section.

6. The recreational watercraft of claim 5 wherein said frame mounts are comprised of:

an arc base;

a frame rail cradle sized to accommodate said linear frame rails; and a gusset connected between said arc base and said frame rail cradle;

wherein said arc base has at least one orifice for the passage of a mechanical connector to connect said frame mount to said hemispherical curved plate.

7. The recreational watercraft of claim 6 wherein at least one of said frame connectors is a first hinge connector and comprises:

a male hinge half having a first square socket sized to accommodate said ends of said frame rails and a planar first leaf extending normally therefrom;

a female hinge half with a second square socket sized to accommodate said ends of said frame rails and with a pair of parallel and opposing second leaves extending normally therefrom said second square socket;

at least one of a mechanical connector;

wherein said first leaf frictionally fits between said parallel and opposing second leaves and said at least one mechanical connector joins said male half hinge and said female half hinge; and wherein said male hinge half and said female hinge half pivot about said mechanical fastener.

8. The inflateable watercraft of claim 7 wherein at least one of said frame connectors is a second hinge connector and comprises:

a male base leaf with a first planar leaf residing between two identical, opposing first square sockets sized to accommodate said ends of said frame rails;

two identical female hinge halves, each with a second square socket sized to accommodate said ends of said frame rails and with a pair of parallel and opposing second leaves extending normally therefrom said second square socket;

at least two mechanical connectors;

wherein said male base leaf frictionally fits between said parallel and opposing second leaves of both female hinge halves, and one of said mechanical connectors joins said male base leaf and each of said female half hinges; and wherein said male hinge half and each of said female hinge halves pivot about said mechanical fastener.

9. The recreational watercraft of claim 7 further comprising:

four inflatable conical tubes each having a conical longitudinal configuration with a large end, a small end and a tapered tube side wall therebetween;

each of said conical tubes having a zipper portion selected from the set consisting of first zipper portions and second zipper portions, said zipper portion affixed to said large end of said conical tube;

wherein each said conical tube is connected at said large end to said proximal end or said distal end of said linear tube by engagement of its zipper portion.

* * * * *